United States Patent [19]

Nguyen et al.

[11] Patent Number: 5,019,473

[45] Date of Patent: May 28, 1991

[54] ELECTROPHOTOGRAPHIC RECORDING ELEMENTS CONTAINING PHOTOCONDUCTIVE PERYLENE PIGMENTS

[75] Inventors: Khe C. Nguyen, Pittsford; William T. Gruenbaum, Rochester, both of N.Y.

[73] Assignee: Eastman Kodak Company, Rochester, N.Y.

[21] Appl. No.: 485,113

[22] Filed: Feb. 23, 1990

[51] Int. Cl.[5] ..... G03G 5/14

[52] U.S. Cl. ..... 430/58; 430/73; 430/74

[58] Field of Search ..... 430/58, 73, 74

[56] References Cited

U.S. PATENT DOCUMENTS

| | | | |
|---|---|---|---|
| 3,752,686 | 8/1973 | Kalz et al. . | |
| 4,419,427 | 12/1983 | Graser | 430/58 |
| 4,555,467 | 11/1985 | Hasegawa et al. . | |
| 4,578,334 | 3/1986 | Borsenberger et al. . | |
| 4,714,666 | 12/1987 | Wiedemann et al. . | |
| 4,792,508 | 12/1988 | Kazmaier et al. . | |

*Primary Examiner*—David Welsh

*Attorney, Agent, or Firm*—David F. Janci

[57] ABSTRACT

An electrophotographic recording element having a layer comprising a photoconductive perylene pigment, as a charge generation material, that is sufficiently finely and uniformly dispersed in a polymeric binder to provide the element with excellent electrophotographic speed. The perylene pigments are perylene-3,4,9,10-tetracarboxylic acid imide derivatives.

12 Claims, No Drawings

ELECTROPHOTOGRAPHIC RECORDING ELEMENTS CONTAINING PHOTOCONDUCTIVE PERYLENE PIGMENTS

FIELD OF THE INVENTION

This invention relates to electrophotographic recording elements in general and particularly to an electrophotographic element having a layer containing a photoconductive perylene pigment dispersed in a polymeric binder. More particularly, the invention relates to an electrophotographic element containing a layer of finely-divided perylene-3,4,9,10-tetracarboxylic acid imide pigment dispersed in a polymeric binder. Such a layer exhibits unexpectedly good photosensitivity and high resistance to abrasion, and is characterized by good durability.

BACKGROUND

In electrophotography an image comprising an electrostatic field pattern, usually of non-uniform strength (also referred to as an electrostatic latent image), is formed on an insulative surface of an electrophotographic element comprising at least a photoconductive layer and an electrically conductive substrate. The electrostatic latent image is usually formed by imagewise radiation-induced dissipation of the strength of portions of an electrostatic field of uniform strength previously formed on the insulative surface. Typically, the electrostatic latent image is then developed into a toner image by contacting the latent image with an electrographic developer. If desired, the latent image can be transferred to another surface before development.

In latent image formation the imagewise radiation-induced dissipation of the initially uniform electrostatic field is brought about by the creation of electron/hole pairs, which are generated by a material, often referred to as a photoconductive or charge-generation material, in the electrophotographic element in response to exposure to imagewise actinic radiation. Depending upon the polarity of the initially uniform electrostatic field and the types of materials included in the electrophotographic element, part of the charge that has been generated, i.e., either the holes or the electrons, migrates toward the charged insulative surface of the element in the exposed areas and thereby causes the imagewise dissipation of the initial field. What remains is a non-uniform field constituting the electrostatic latent image.

Several types of electrophotographic recording elements are known for use in electrophotography. In many conventional elements, the active photoconductive or charge-generation materials are contained in a single layer. This layer is coated on a suitable electrically conductive support or on a non-conductive support that is overcoated with an electrically conductive layer. In addition to single-active-layer electrophotographic recording elements, various multi-active electrophotographic recording elements are known. Such elements are sometimes called multi-layer or multi-active-layer elements because they contain at least two active layers that interact to form an electrostatic latent image.

A class of photoconductive materials useful in the aforementioned single-active-layer and multiactive elements is the class of perylene pigments, particularly perylene-3,4,9,10-tetracarboxylic acid imide derivatives. Representative examples of patents pertaining to such perylene photoconductive pigments include, U.S. Pat. No. 4,578,334, issued Mar. 25, 1986, which describes multi-active electrophotographic recording elements that contain, as photoconductive materials, certain crystalline forms of N,N'-bis(2-phenethyl)perylene-3,4:9,10-bis(dicarboximide) characterized by particular spectral absorption and x-ray diffraction characteristics; U.S. Pat. No. 4,714,666, issued Dec. 22, 1987, which describes single-active-layer electrophotographic elements and multi-active elements containing, as photoconductive materials, asymmetrically substituted perylene-3,4,9,10-tetracarboxylic acid imide derivatives, and U.S. Pat. No. 4,792,508, issued Dec. 20, 1988, which describes multi-active elements that contain as photoconductive materials, mixtures of cis- and trans-naphthimidazole perylenes.

Unfortunately, electrophotographic recording elements of the prior art which contain photoconductive perylene materials have typically suffered from one or more disadvantages that have significantly restricted their use. For example, vacuum sublimation (also known as vacuum deposition) is frequently required to deposit photoconductive perylene pigments in a crystal form suitable for high speed electrophotographic elements. Thus, U.S. Pat. No. 4,578,334 describes a process wherein a perylene pigment is deposited by vacuum sublimation in the form of an amorphous layer and is thereafter converted to photoconductive crystalline form by contacting the layer with an appropriate liquid composition. Vacuum sublimation, however, is a batch process which makes production scale runs quite costly and thin sublimed films are fragile and susceptible to damage until they can be protected by a more durable overcoat.

To avoid the disadvantages inherent in forming photoconductive perylene pigment layers using vacuum sublimation techniques and the fragile nature of such layers; electrophotographic layers have been coated from liquid coating compositions comprising finely-divided photoconductive perylene pigments dispersed in solvent solutions of polymeric binders. See, for example, U.S. Pat. No. 4,714,666. Electrophotographic layers coated from such dispersions are more resistant to abrasion and more durable than the layers formed by vacuum sublimation but, these advantages are obtained at the expense of a considerable loss in electrophotographic speed. U.S. Pat. No. 4,714,666 illustrates this point very well since such loss in speed is evident from a comparison between electrophotographic speeds reported in the working examples for electrophotographic recording elements containing perylene pigments in dispersion coated layers and those elements containing such pigments in vacuum deposited layers.

Also, dispersion coated layers containing photoconductive perylene pigments provided by conventional prior art methods are deficient in several respects, for example, the pigments have a relatively large particle size and are poorly dispersed in the binder and do not form homogeneous layers having the uniform distribution of fine particles that is necessary to achieve optimum electrophotographic speed. In addition, such layers often contain agglomerates of individual pigment particles and such agglomerates detrimentally affect the image quality of copies formed with electrophotographic elements containing the layers.

Conventional prior art procedures normally used for forming dispersion-coated layers typically involve mixing the components of a liquid coating composition, for example, a dispersion of photoconductive perylene pigment in a solvent solution of polymeric binder, in a suitable mixing device such as a ball mill or a paint shaker. As previously indicated, such conventional procedures do not adequately disperse the pigment particles and frequently form the aforementioned particle agglomerates. Moreover, prolonged mixing of the photoconductive perylene pigment in a device such as a ball mill can damage the pigment structurally so that electrophotographic performance is detrimentally affected.

It is an objective of this invention to provide electrophotographic recording elements that comprise photoconductive perylene pigments and have excellent photosensitivity, for example, photodischarge speed and dark decay, but do not require vacuum sublimation techniques to achieve such photosensitivity. It is also an objective of this invention to provide electrophotographic recording elements comprising layers containing photoconductive pigments dispersed in polymeric binders, which layers are highly resistant to abrasion and exhibit good durability.

SUMMARY OF THE INVENTION

This invention provides an electrophotographic recording element that has a layer in which photoconductive perylene pigment is dispersed in a polymeric binder and exhibits excellent electrophotographic speed. Thus, the electrophotographic recording element of this invention is an electrophotographic recording element having a layer comprising a photoconductive perylene pigment that is sufficiently finely and uniformly dispersed in a polymeric binder to provide the element with an electrophotographic speed at least substantially equivalent to the electrophotographic speed of an element having a corresponding layer formed from the same pigment by vacuum sublimation in the absence of said polymeric binder. The perylene pigment has the formula:

(I)

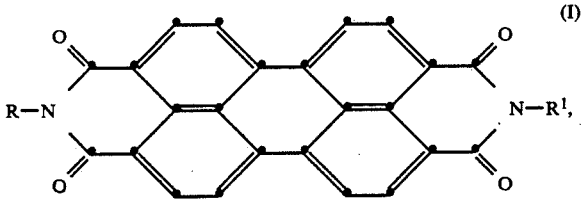

(II)

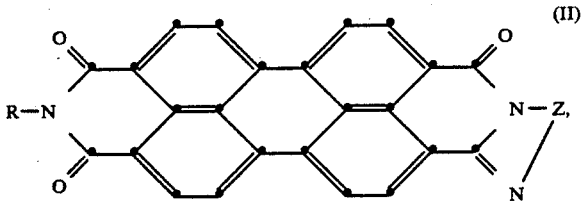

or (III)

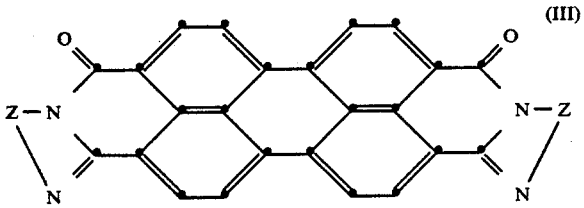

where each R is a phenethyl radical, $R^1$ is hydrogen, alkyl, cycloalkyl, aralkyl, aryl, heteroaryl, alkoxy, mono- or dialkylamino, or when the compound of Formula I is a dimer, $R^1$ is 1,4-phenylene, each Z is 2,3-naphthylene, 2,3-pyridylene, 3,4-pyridylene, 3,4,5,6-tetrahydro-1,2-phenylene, 9,10-phenanthrylene, 1,8-naphthylene, the radical

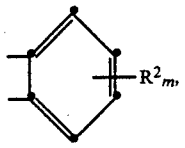

where $R^2$ is alkyl, cycloalkyl, aralkyl, aryl, heteroaryl, alkoxy, dialkylamino, halogen, cyano, or nitro, or when the compound of Formula II is a dimer, Z is 1,2,4,5-benzenetetrayl or 3,3',4,4'-biphenyltetrayl, and m is a number from 0 to 4, The electrophotographic recording elements of this invention exhibit a broad range of sensitivity, e.g., they exhibit electrophotographic response over the visible region of the spectrum (400–700 nm), and in some cases out into the infrared region, and often exhibit an unexpected increase in electrophotographic response at all wavelengths within such regions.

DESCRIPTION OF THE PREFERRED EMBODIMENTS

The photoconductive perylene pigments used in this invention are 3,4,9,10-tetracarboxylic acid imide derivatives that contain at least one phenethyl radical and/or fused imidazo[1,2-a]pyridino ring moiety. Such perylene pigments can be symmetrical or asymmetrical depending upon the nature of the specific substituents, for example, the $R^1$ or Z radicals in formulas I, II or III. Also, while formula III specifically sets forth the cis form of the perylene pigment, other forms such as trans forms do exist and such forms of the pigments are included within the scope of this invention.

The R radical in formula I or II is a phenethyl radical, i.e., a radical in which an ethylene linkage joins a phenyl moiety to a 3,4-dicarboximide nitrogen atom. The ethylene linkage and/or phenyl moiety can be unsubstituted or can contain substituents that do not deleteriously affect the photoconductive properties of the perylene pigment. Suitable substituents of this type include for example, alkyl radicals, such as methyl, ethyl, propyl, isopropyl, butyl, isobutyl, sec-butyl and tert-butyl; cycloalkyl radicals such as cyclopropyl, cyclobutyl, cyclopentyl and cyclohexyl; aralkyl radicals such as benzyl and phenethyl; aryl radicals such as phenyl, chlorophenyl, anisyl, biphenyl and naphthyl; heteroaryl radicals such as pyridyl, pyrimidyl, thiophenyl, pyrrolyl and furyl; alkoxy radicals such as methoxy and ethoxy; dialkylamino radicals containing the same or different alkyls such as dimethylamino, diethylamino, and methylbenzylamino; and halogen such as chlorine, bromine or fluorine. In addition to the specific $R^1$ radicals set forth in formula I, illustrative $R^1$ substituents include alkyl radicals such as methyl, ethyl, propyl, isopropyl, butyl, pentyl, hexyl, methoxyethyl and methoxypropyl; cycloalkyl radicals such as cyclopropyl, cyclobutyl, cyclopentyl and cyclohexyl; aralkyl radicals such as benzyl, phenethyl, phenylpropyl and phenylbutyl; aryl radicals such as phenyl, tolyl, xylyl, biphenylyl and naphthyl; and heteroaryl radicals such as pyridyl and pyrimidyl.

Some illustrative $R^2$ substituents in formulas II and III include alkyl radicals, such as methyl, ethyl, propyl, isopropyl, butyl, isobutyl, sec-butyl, and tert-butyl; cycloalkyl radicals such as cyclopropyl, cyclobutyl, cyclopentyl and cyclohexyl; aralkyl radicals such as benzyl and phenethyl; aryl radicals such as phenyl, chlorophenyl, anisyl, biphenyl and naphthyl; heteroaryl radicals such as pyridyl, pyrimidyl, thiophenyl, pyrrolyl and furyl; alkoxy radicals such as methoxy and ethoxy; dialkylamino radicals containing the same or different alkyls such as dimethylamino, diethylamino, and methylbenzylamino; and halogen such as chlorine, bromine or fluorine.

Although the R, $R^1$ and $R^2$ radicals generally contain only carbon and hydrogen, they often contain additional atoms such as oxygen, nitrogen, sulfur and halogen. Also, it is evident from the previous description of formula II and III and the following Tables 2 and 3 that the imidazo[1,2-a]-pyridino ring moiety (which includes the Z substituent) in the photoconductive perylene pigments employed in the practice of this invention can contain a wide variety of substituents, including fused ring systems of carbon or carbon and hetero atoms, each ring containing 5 or more carbon or carbon and hetero atoms such as fused benzene, naphthalene, pyrimidine or pyridine rings.

Symmetrical perylene 3,4,9,10-tetracarboxylic acid imide derivatives that can be used in the practice of this invention are conveniently prepared by cyclizing perylene tetracarboxylic dianhydrides with an excess of suitable organic amines such as phenylethyl amine or diaminonaphthalene. Typical procedures are described in U.S. Pat. No. 4,156,757, issued May 29, 1979, and in U.S. Pat. Nos. 4,578,334; and 4,792,508, referred to previously herein. Typical procedures for preparing asymmetrical perylene-3,4,9,10-tetracarboxylic acid imide derivatives employed in the practice of this invention are described in U.S. Pat. No. 4,714,666, previously referred to herein. Synthesis of dimeric phenylene-3,4,9,10-tetracarboxylic acid imide derivatives can be carried out by methods analogous to those described in U.S. Pat. No. 4,714,666 except that at least 2 moles of a perylene tetracarboxylic acid monoanhydride monoimide is cyclized by reaction with 1 mole of an appropriate polyfunctional organic amine such as 1,4-phenylenediamine or 1,2,4,5-benzenetetraamine.

A partial listing of perylene pigments of formula I that can be used in this invention is set forth in the following Table 1 where R and $R^1$ in that formula I are set forth.

TABLE 1

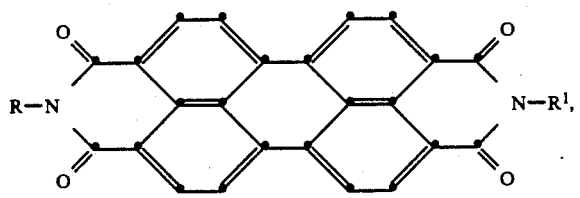

(I)

| Pigment | R | $R^1$ |
|---|---|---|
| P-1 | 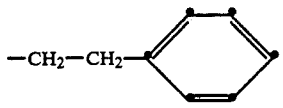 | 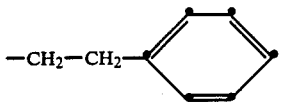 |
| P-2 | 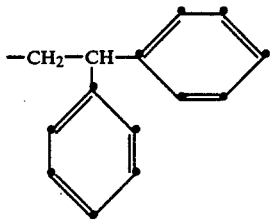 | 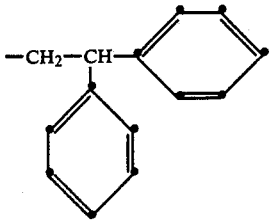 |
| P-3 | 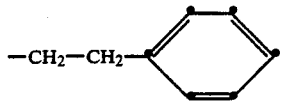 | 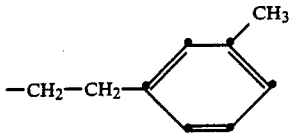 |
| P-4 | 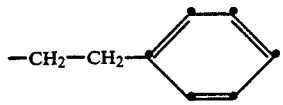 | $-CH_2CH_2CH_3$ |

TABLE 1-continued
(I)
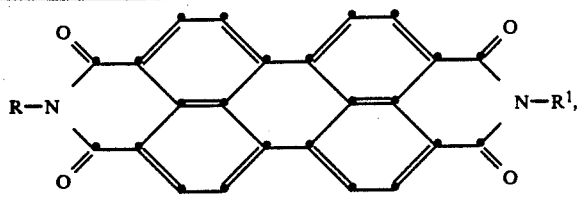
| Pigment | R | $R^1$ |
|---|---|---|
| P-5 | 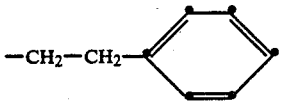 | 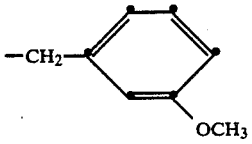 |
| P-6 | 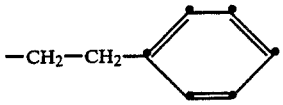 | $-CH_2CH_2CH_2OCH_3$ |
| P-7 | 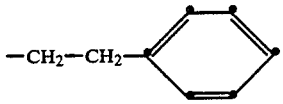 | $-H$ |
| P-8 | 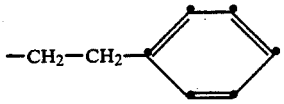 | 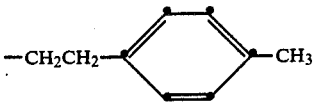 |
| P-9 | 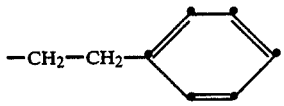 | $-CH_2CH_2OCH_3$ |
| P-10 | 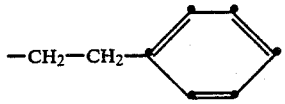 | $-CH_2CH_2CH_2SCH_3$ |
| P-11 | 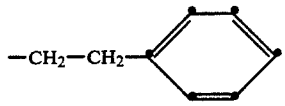 | 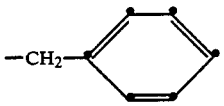 |
| P-12 | 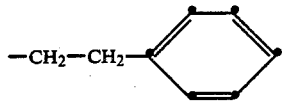 | 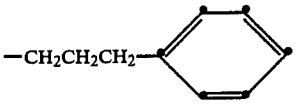 |
| P-13 | 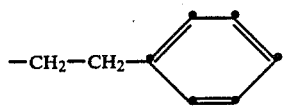 | 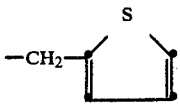 |
| P-14 | 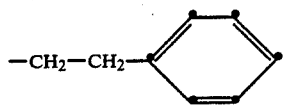 | 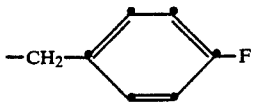 |
| P-15 | 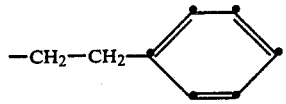 | 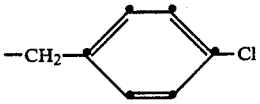 |

TABLE 1-continued
(I)
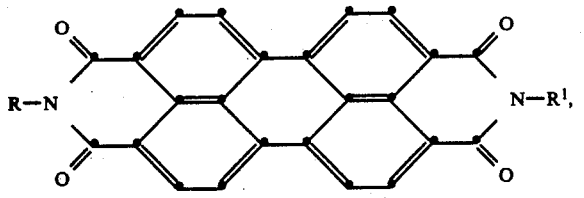
| Pigment | R | R¹ |
|---|---|---|
| P-16 | 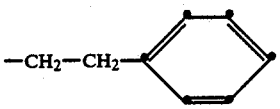 | 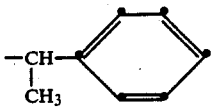 |
| P-17 | 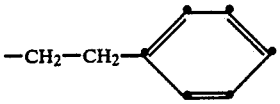 | 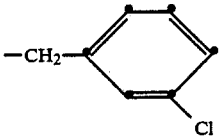 |
| P-18 | 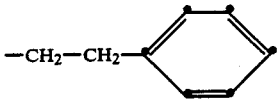 | $-CH_3$ |
| P-19 | 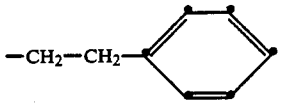 | 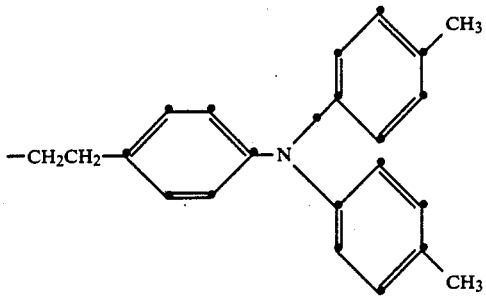 |
| P-20 | 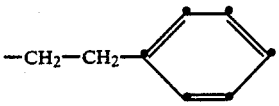 | 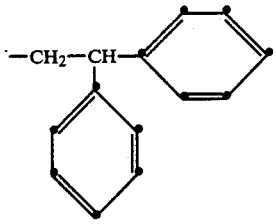 |
| P-21 | 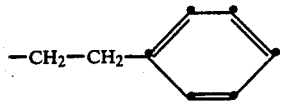 | 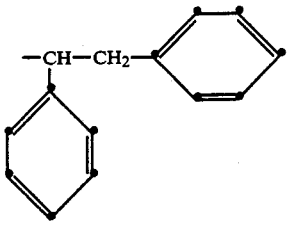 |
| P-22 | 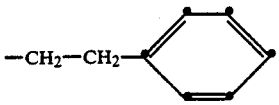 | 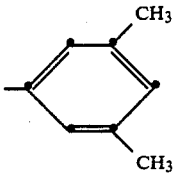 |

TABLE 1-continued
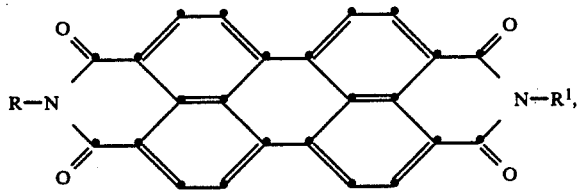
(I)
| Pigment | R | R¹ |
|---|---|---|
| P-23 | 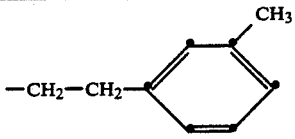 | —CH₂CH₂CH₂OCH₃ |
| P-24 | 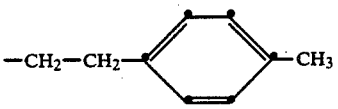 | —CH₂CH₂CH₂OCH₃ |
| P-25 | 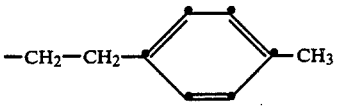 | 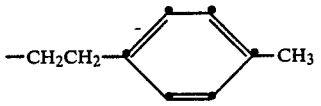 |
| P-26 | 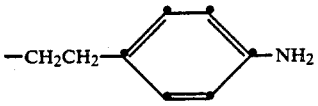 | 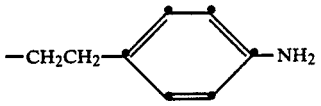 |
| P-27 | 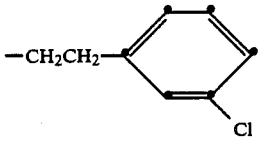 | 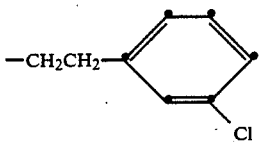 |
| P-28 | 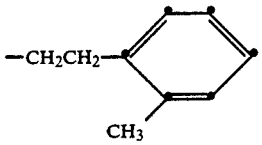 | 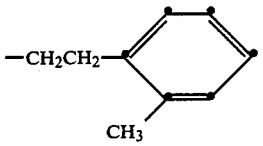 |
| P-29 | 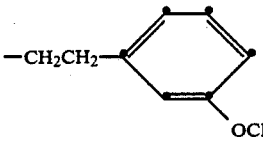 | 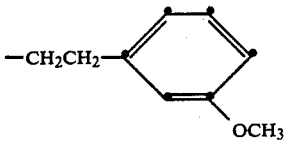 |
| P-30 | 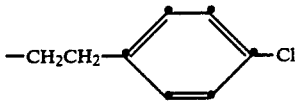 | 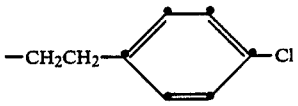 |
| P-31 | 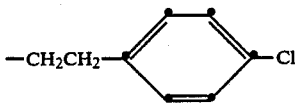 | 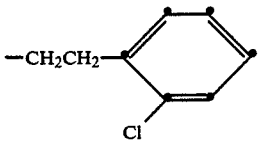 |
| P-32 | 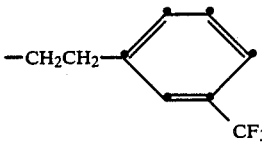 | 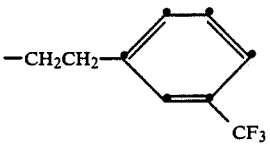 |

TABLE 1-continued
(I)
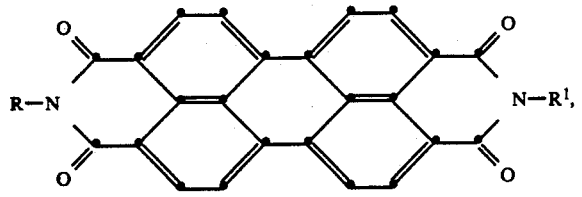
| Pigment | R | $R^1$ |
|---|---|---|
| P-33 | 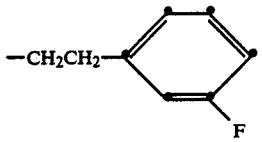 | 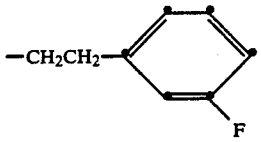 |
| P-34 | 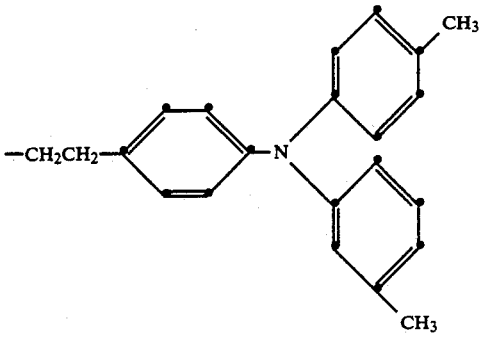 | 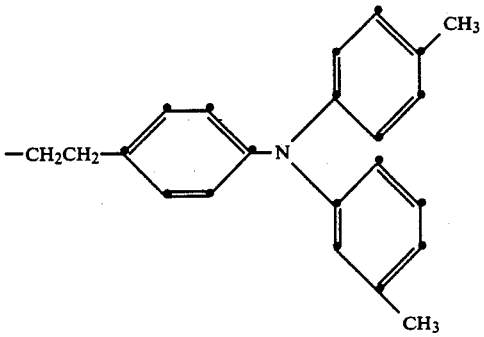 |
| P-35 | 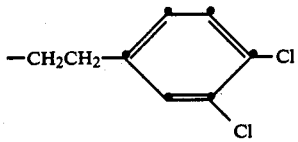 | 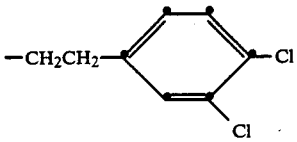 |
| P-36 | 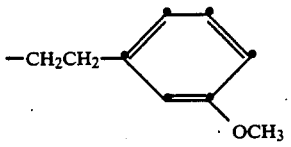 | 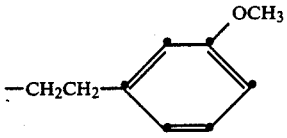 |
| P-37 | 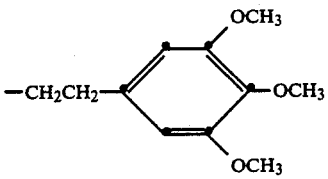 | 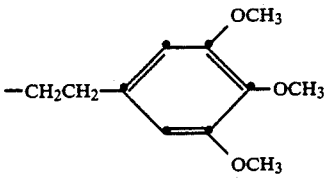 |
A partial listing of perylene pigments of formula II that can be used in this invention is set forth in the following Table 2. In each case R in formula II is phenethyl and Z, $R^2$ and m are as defined in the Table.

TABLE 2
(II)
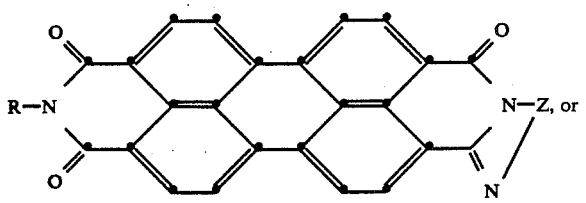
| Pigment | Z | $R^2$ | m |
|---|---|---|---|
| P-38 | 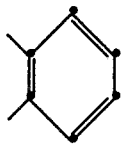 | — | — |
| P-39 | 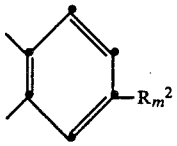  | $CH_3$ | 1 |
| P-40 | 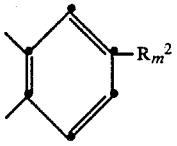  | Cl | 1 |
| P-41 | 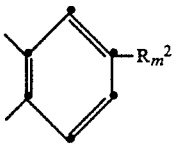  | $NO_2$ | 1 |
| P-42 | 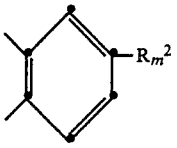  | F | 1 |
| P-43 | 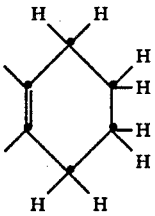  | — | — |
| P-44 | 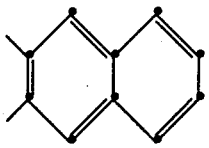 | — | — |
| P-45 | 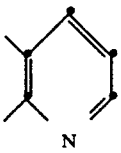  | — | — |

TABLE 2-continued
(II)
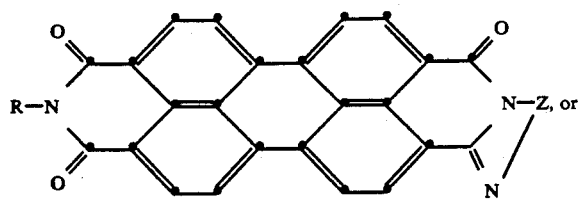
| Pigment | Z | $R^2$ | m |
|---|---|---|---|
| P-45a | 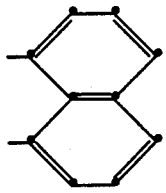 | — | — |
| P-46 | 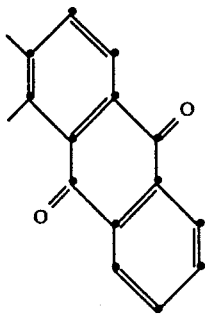 | — | — |
| P-47 | 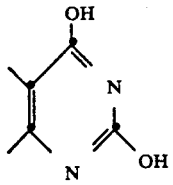 | — | — |
| *P-48 | 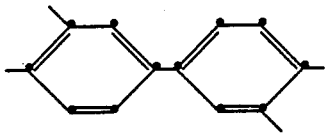 | — | — |
| *P-50 | 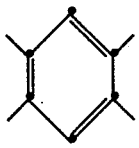 | — | — |
*Dimers
A partial listing of perylene pigments of formula III that can be used in this invention is set forth in the following Table 3 where each Z is the same and, $R^2$ and m in formula III are as defined.

TABLE 3
(III)
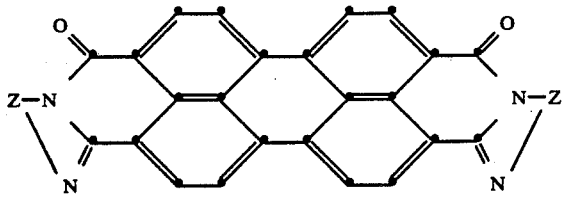
| Pigment | Z | $R^2$ | m |
|---|---|---|---|
| P-51 | 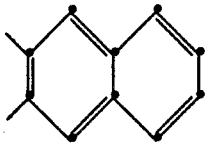 | — | — |
| P-52 | 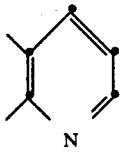 | — | — |
| P-53 | 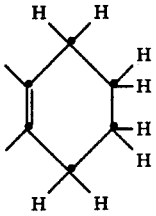 | — | — |
| P-54 | 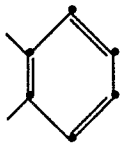 | — | — |
| P-55 | 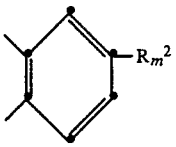 | Cl | 1 |
| P-56 | 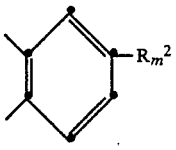 | $NO_2$ | 1 |
| P-57 | 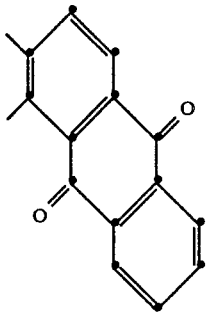 | — | — |

TABLE 3-continued (III)

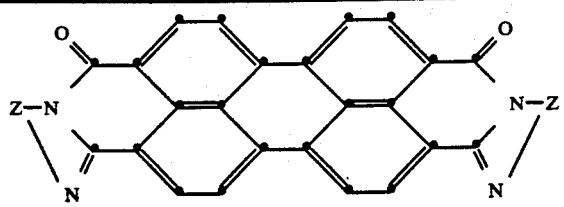

| Pigment | Z | $R^2$ | m |
|---|---|---|---|
| P-58 | 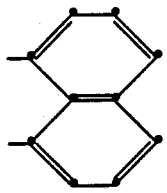 | — | — |

The photoconductive layers in the electrophotographic recording elements of this invention are prepared using unique coating compositions in which finely-divided perylene pigments are very uniformly dispersed in a solvent solution of polymeric binder. Briefly, such coating compositions are prepared by a method that comprises the steps of (1) milling a crude perylene pigment having a formula I, II or III with milling media comprising inorganic salt and non-conducting particles under shear conditions in the substantial absence of binder solvent to provide pigment having a particle size up to 0.2 micrometer, (2) continuing the milling at higher shear and a temperature up to about 50° C., to achieve a perceptible color change of the pigment particles, (3) rapidly reducing the temperature of the milled pigment by at least 10° C., (4) separating the milled pigment from the media and (5) mixing the milled pigment with a solvent solution of polymeric binder to form the coating composition. A very high degree of dispersion of photoconductive perylene pigment in solvent solution of polymeric binder is achieved by this method. This is quite unexpected since it has been our experience that 3,4,9,10-tetracarboxylic acid imide derivatives of the type having formulas I, II and III are particularly difficult to effectively disperse in liquid coating compositions used to form electrophotographic layers.

The crude perylene pigment used to form the coating composition is an as-synthesized pigment and has a much larger particle size than does the electrophotographic quality pigment, i.e., the photoconductive perylene pigment. Also, perylene pigments are known to exhibit polymorphism, i.e., they are capable of existing in various crystal forms, as well as amorphous forms. The milling method provides a perylene pigment that is in a finely-divided photoconductive form capable of achieving a high degree of dispersion in electrophotographic coating compositions. While the exact mechanism whereby the process functions to achieve the improved results is not known with certainty, during milling the solvent and polymeric binder are not brought into association with the pigment particles until such particles are finely-divided and free from agglomerates. Accordingly, any adverse influences due to the presence of polymeric binder and/or solvent on the formation of finely-divided particles and breaking up of agglomerates and dispersion of individual particles are avoided. After milling, the particles can be effectively dispersed in the solvent solution of polymeric binder using a conventional mixing device such as a media mill or a paint shaker to form the coating composition. Such pigment particles have a very uniform size distribution and the size of the individual particles does not exceed 0.2 micrometer. While the milling process can be applied to mixtures of two or more perylene pigments, optimum electrophotographic properties are generally obtained by milling the pigments separately and then adding them to the coating composition which is subjected to conventional mixing techniques prior to dispersion coating the electrphotographic recording element.

During the first milling stage, the perylene pigment is mechanically ground in the dry state under shear conditions that break up particle agglomerates and provide particles having a very small size. As synthesized, perylene pigments normally have a particle size that is too large for them to be effectively used in electrophotographic applications. In this condition, they are known in the prior art as "crude" pigments. Such crude pigments normally have a particle size in excess of 10 micrometers, often a particle size of 50 micrometers, and in at least some cases, at least 1 millimeter. In this first milling stage, the particle size is reduced to a particle size that does not exceed about 0.2 micrometer, typically a particle size of about 0.02 to 0.2 micrometer and often about 0.05 to 0.1 micrometer. The pigment particles have a variety of shapes, e.g., elongated, needle-like, spherical, regular or irregular. The practical size referred to herein is the largest dimension of the particle and can be readily determined from electron photomicrographs using techniques well known to those skilled in the art. Milling is carried out in the substantial absence of the solvent and the polymeric binder, i.e., there is either none of these ingredients present or, if some polymeric binder and/or solvent is included, it is in an amount so small as to have no significant detrimental effect on the pigment particles.

In the first stage of the milling, the perylene pigment particles are milled under shear such that the particle size of the pigment is reduced to at least 0.2 micrometer and the pigment and milling media form a homogeneous mixture. Milling apparatus capable of providing such shear with the milling mixture are well known and include, e.g., conventional ball mills, roll mills, paint shakers, vibrating mills and the like. Examples of milling apparatus that can utilize shearing are described in U.S. Pat. Nos. 4,555,467, issued Nov. 26, 1985 and 3,752,686, issued Aug. 14, 1973. The shear employed with a given mixture is subject to variation, as is obvious to those skilled in the art, depending upon such things as the type of milling apparatus, milling media and perylene pigment selected. However, the energy applied to the non-conductive particles in the milling media which results in appropriate shear in the first milling stage generally does not exceed about 5 watts, and is typically in the range of about 3 to 5 watts.

The milling media used to grind the perylene pigment comprises two components, i.e., inorganic salt particles and non-conducting particles in a weight ratio of about 0.5:1 to 3:1, typically about 1:1 to 2:1. Examples of inorganic salts include alkali metal halides, carbonates, sulfates or phosphates such as sodium chloride, potassium bromide, sodium sulfate, potassium sulfate, sodium carbonate, and sodium phosphate. In prior art milling methods where such inorganic salt particles are used in milling media with other particles, e.g., steel balls, they are normally used as milling aids at considerably lower concentrations. Such salts are typically separated from the milled pigment by washing with water since they often have a high degree of solubility in water, e.g., a solubility of at least 200 and often 400 grams of salt per liter of water. Examples of non-conductive particles include materials such as glass particles, zirconium oxide particles and organic polymeric beads such as polymethyl methacrylate beads that are electrically non-conducting. Non-conductive particles are employed because they do not acquire charges due to triboelectrification which charges would cause pigment to adhere to the particles. Furthermore, the use of non-conducting particles limits corrosion due to the presence of the inorganic salt particles that might otherwise occur under the milling conditions. The inorganic salts typically have particle sizes in the range of about 5 to 500 micrometers while the particle size of the non-conducting particles is normally in the range of about 0.5 mm to about 5 mm.

Following comminution of the crude pigment in the first milling stage, milling is continued in a second stage at higher shear and at a temperature up to 50° C. Milling is continued until there is a perceptible color change of the pigment. This is the point at which there is a just noticeable difference in the color of the pigment which can be detected by observation with the unaided human eye. It is also interesting to note that the perylene pigment is substantially completely adsorbed to the surfaces of the inorganic salt particles when milling is completed. This is an excellent indicator of milling completion. During this second milling stage, shear can be increased simply by increasing the concentration of milling media. However, it is often convenient to simply transfer the milled composition from the first stage milling (comprising pigment and milling media) to a device that will develop increased shear relative to the shear used in the first stage. For example, where a ball mill is used is the first stage, this can be followed by using an attritor in the second milling stage, as illustrated in the following Examples. However, other devices such as jet mills or high speed roll mills are suitable for use for the second milling stage. The milling temperature in the second stage does not exceed about 50° C. and is generally in the range of about 0° C. to 50° C., typically in the range of about 20° C. to about 45° C. The milling time, in stages 1 and 2 will vary greatly, depending upon a number of factors such as the relative proportions of pigment and milling media and the specific milling equipment utilized. Generally, a suitable time for the stage 1 milling can be as much as 240 hours with typical times being in the range of about 72 hrs to 120 hrs, while, in the second stage, the milling time is generally about 10 min to 5 hrs, often about 30 min to 90 min. Typically, the concentration of the perylene pigment during milling is about 0.01% to 10%, often about 0.5% to 5% by weight, based on the weight of milling media. The milling operation tends to result in a liberation of heat which raises the temperature of the milling composition, i.e., the mixture of pigment and milling media. The milling apparatus is, therefore, normally equipped with cooling means to keep the temperature below 50° C.

Upon completion of stage 2 milling, the temperature of the milled pigment is rapidly reduced by at least 10° C. often by 10° C. to 60° C. The rapid reduction in temperature stabilizes the pigment against changes in morphology and crystal form prior to its addition to the solvent solution of polymeric binder. It is usually convenient to reduce the temperature of the milled mixture by quenching with water, for example, ice water or room temperature water depending upon the temperature of the milled mixture. However, other cooling means, for example, ice or cold air, can be used, but water is preferred since it dissolves the inorganic salt particles which facilitates recovery of the pigment. The non-conducting solid particles can be removed from the mixture using any suitable means such as filtration or centrifuging.

Following separation of the milled pigment from the milling media, the pigment is mixed with a solvent solution of polymeric binder to form an electrophotographic coating composition. The pigment can be mixed with the solvent solution of polymeric binder immediately or it can be stored for some period of time before making up the coating composition. The polymeric binder used in the preparation of the coating composition can be any of the many different binders that are useful in the preparation of electrophotographic layers. Representative materials that can be employed as binders in the practice of this invention are film-forming polymers having a fairly high dielectric strength and good electrically insulating properties. Such binders include, for example, styrene-butadiene copolymers; vinyl toluene-styrene copolymers; styrene-alkyd resins; silicone-alkyd resins; soya-alkyd resins; vinylidene chloride-vinyl chloride copolymers; poly(vinylidene chloride); vinylidene chloride-acrylonitrile copolymers; vinyl acetate-vinyl chloride copolymers; poly(vinyl acetals), such as poly(vinyl butyral); nitrated polystyrene; poly(methylstyrene); isobutylene polymers; polyesters, such as poly[ethylene-co-alkylenebis-(alkyleneoxyaryl)-phenylenedicarboxylate]; phenol-formaldehyde resins; ketone resins; polyamides; polycarbonates; polythiocarbonates; poly[ethylene-co-isopropylidene-2,2-bis(ethyleneoxyphenylene)terephthalate]; copolymers of vinyl haloacrylates and vinyl acetate such as poly(vinyl-m-bromobenzoate-co-vinyl acetate); chlorinated poly(olefins), such as chlorinated poly(ethylene); cellulose derivatives such as cellulose acetate, cellulose acetate butyrate and ethyl cellulose; and polyimides, such as poly[1,1,3-trimethyl-3-(4'-phenyl)-5-indane pyromellitimide].

Suitable organic solvents for forming the polymeric binder solution can be selected from a wide variety of organic solvents, including, for example, aromatic hydrocarbons such as benzene, toluene, xylene and mesitylene; ketones such as acetone, butanone and 4-methyl-2-pentanone; halogenated hydrocarbons such as methylene chloride, chloroform and ethylene chloride; ethers, including ethyl ether and cyclic ethers such as dioxane and tetrahydrofuran; and mixtures thereof. The amount of solvent used in forming the binder solution is typically in the range of from about 2 to about 100 parts of solvent per part of binder by weight, and preferably in the range of from about 10 to about 50 parts of solvent per part of binder by weight.

As previously indicated herein, the electrophotographic elements of this invention can be of various types, all of which contain photoconductive perylene derivative that serve as charge-generating materials in the elements. Such elements include both those commonly referred to as single layer or single-active-layer elements and those commonly referred to as multiactive, multilayer, or multi-active-layer elements which have been briefly referred to previously herein. All of these elements exhibit an electrophotographic speed that is at least equal to comparable electrophotographic recording elements in which the photoconductive perylene derivative is vacuum deposited.

Single layer elements contain one layer that is active both to generate and to transport charges in response to exposure to actinic radiation. Such elements typically comprise at least an electrically conductive layer in electrical contact with a photoconductive layer. In single layer elements prepared as described herein, the photoconductive layer contains at least one photoconductive perylene pigment as the charge-generation material to generate charge in response to actinic radiation and a transport material which is capable of accepting charges generated by the charge-generation material and transporting the charges through the layer to effect discharge of the initially uniform electrostatic potential. The photoconductive layer is electrically insulative, except when exposed to actinic radiation, and contains an electrically insulative film-forming polymeric binder.

Multiactive elements contain at least two active layers, at least one of which is capable of generating charge in response to exposure to actinic radiation and is referred to as a charge-generation layer (hereinafter also referred to as a CGL), and at least one of which is capable of accepting and transporting charges generated by the charge-generation layer and is referred to as a charge-transport layer (hereinafter also referred to as a CTL). Such elements typically comprise at least an electrically conductive layer, a CGL, and a CTL. Either the CGL or the CTL is in electrical contact with both the electrically conductive layer and the remaining CGL or CTL. The CGL contains at least a photoconductive material that serves as a charge-generation material; the CTL contains at least a charge-transport material; and either or both layers can contain an additional film-forming polymeric binder. In multiactive elements of this invention the charge-generation material is at least one photoconductive perylene pigment dispersed in a polymeric binder and the element contains a CTL. Any suitable charge-transport material can be used in such CTL's.

Single layer and multilayer electrophotographic elements and their preparation and use, in general, are well known and are described in more detail, for example, in U.S. Pat. Nos. 4,701,396; 4,714,666; 4,666,802; 4,578,334; 4,175,960; 4,514,481; and 3,615,414, the disclosures of which are hereby incorporated herein by reference.

In preparing single-active-layer electrophotographic elements of the invention, the components of the photoconductive layer, including any desired addenda, can be dissolved or dispersed in the coating composition and then coated on an electrically conductive layer or support. The solvent for the polymeric binder is then allowed or caused to evaporated from the mixture to form the permanent layer containing from about 0.01 to 50 weight percent of the charge-generation material and about 10 to 70 weight percent of a suitable charge transport material.

In preparing multiactive electrophotographic elements, the components of the CTL can similarly be dissolved or dispersed in the coating composition and can be coated on either an electrically conductive layer or support or on a CGL previously similarly coated or otherwise formed on the conductive layer or support. In the former case a CGL is thereafter coated on the CTL.

Various electrically conductive layers or supports can be employed in the electrophotographic recording elements of this invention, such as, for example, paper (at a relative humidity above 20 percent); aluminum-paper laminates; metal foils such as aluminum foil and zinc foil; metal plates such as aluminum, copper, zinc, brass and galvanized plates; vapor deposited metal layers such as silver, chromium, vanadium, gold, nickel, and aluminum; and semiconductive layers such as cuprous iodide and indium tin oxide. The metal or semiconductive layers can be coated on paper or conventional photographic film bases such as poly(ethylene terephthalate), cellulose acetate and polystyrene. Such conducting materials as chromium and nickel can be vacuum-deposited on transparent film supports in sufficiently thin layers to allow electrophotographic elements prepared therewith to be exposed from either side.

When a photoconductive layer of a single-active-layer element or a CGL of a multiactive element is dispersion coated as described herein, the polymeric binder may, if it is electrically insulating, help to provide the element with electrically insulating characteristics. It also is useful in coating the layer, in adhering the layer to an adjacent layer, and when it is a top layer, in providing a smooth, easy to clean, wear-resistant surface. A significant feature of this invention is that an electrophotographic recording element of this invention which contains a CGL formed as described herein contains a photoconductive perylene pigment in a polymeric binder and, therefore exhibits a surface that is much more durable than a comparable layer containing the same perylene pigment but formed by vacuum sublimation. This is advantageous in manufacturing operations where such a CGL is subjected to handling prior to overcoating with, for example, a CTL.

The optimum ratio of charge-generation material (perylene pigment) to polymeric binder may vary widely depending upon the particular material employed. The charge generation material can be a single pigment or it can be two or more pigments. In general, useful results are obtained when the amount of active charge-generation material contained within the layer is within the range of from about 0.01 to 90 weight percent, based on the dry weight of the layer.

Electrophotographic recording elements of this invention can optionally contain other addenda such as leveling agents, surfactants, plasticizers, sensitizers, contrast-control agents, and release agents and they can be coated using any of the wide variety of suitable coating techniques known in the art for forming such elements such as, for example, knife coating, gravure coating or hopper coating. Also, such elements can contain any of the optional additional layers known to be useful in electrophotographic recording elements in general, such as, e.g., subbing layers, overcoat layers, barrier layers, and screening layers.

Electrophotographic recording elements having vacuum deposited charge generation layers comprising a photoconductive perylene pigment are well known in the art, as illustrated for example, by U.S. Pat. Nos. 4,578,334, 4,714,666, and 4,792,508, referred to previously herein. Generally the charge generation layer is first formed as a substantially amorphous layer of photoconductive perylene pigment by vacuum sublimation. Vacuum sublimation is conveniently effected by placing the photoconductive perylene pigment in a crucible contained in a vacuum deposition apparatus and positioning the substrate relative to the crucible so that materials subliming from the crucible will be deposited upon the substrate. The vacuum chamber is typically maintained at a pressure of from about $5\times10^{-4}$ to about $5\times10^{-5}$ Torr, depending upon such variables as the pigment or substrate used. The crucible is heated to a minimum temperature consistent with an adequate rate of sublimation of the perylene pigment. Temperatures in the range of 250° C. to about 400° C. are typical. To facilitate formation of an amorphous layer, the substrate is maintained at a temperature at or below room temperature.

Following vacuum deposition, the amorphous perylene layer is converted to a crystalline photoconductive form having increased photosensitivity. This is normally accomplished by exposing the pigment layer to solvent vapor or treating the pigment layer with a liquid solvent. The latter technique is preferred when it is desired to coat a charge transport layer over the vacuum deposited perylene pigment layer.

By appropriate manipulation of conditions and choice of specific materials known to those skilled in the art an electrophotographic recording element comprising a vacuum deposited perylene pigment layer having a composition and thickness for appropriate comparison with an electrophotographic recording element of this invention can be readily obtained without undue experimentation. The same materials are used to form the electrophotographic recording element by vacuum deposition or by dispersion coating and include, for example, the same perylene pigments, charge transfer materials and supports. To provide comparable electrophotographic recording elements it may be necessary to adjust the thickness of various layers, for example, a charge generation layer and/or a charge transport layer of a specific element such as a multi-active layer electrophotographic recording element. However, such variables are well known to those skilled in the art and do not form a part of this invention. The significant point is that the electrophotographic recording elements of this invention exhibit an electrophotographic speed that is at least equal to that of a comparable electrophotographic recording element in which the perylene pigment layer is formed by vacuum sublimation.

The following examples are presented to further illustrate the invention. For convenience, the perylene pigments are identified in such examples by the "P" number corresponding to that pigment in Table 1, 2 or 3, as previously described.

EXAMPLE 1

A ball mill of 3750 cc capacity was charged with 1800 g of glass beads with a diameter of 2 mm and 1800 g of sodium chloride particles having a diameter of 500 micrometers and 180 g of gold P-38 pigment having a particle size of 0.5 mm. The mixture was then sheared by milling for 72 hrs. at a temperature of 25° C. The resulting mixture was homogeneous and contained gold P-38 pigment that had a particle size of 0.2 micrometer.

The milled mixture obtained from the first stage was transferred to an attritor dry grinding vessel having 10 liters capacity and containing a stirrer having a rotating shaft containing 2 pairs of arms fixed to the rotating shaft and extending toward the side wall of the vessel. 2500 g more of the glass beads and 2000 g more of the sodium chloride particles were added to the attritor and the mixture was agitated at 500 rpm for 70 minutes at a temperature of 45° C. These conditions increased the shear on the mixture in comparison to the first stage. The P-38 pigment changed from gold to a bright pink-/purple color and was adhered to the surface of the inorganic salt particles. The glass beads were removed from the mixture and the pigment and salt particles were stirred in ice for 2 hours. The resulting pigment-sodium chloride mixture was stored at 0° C. for approximately 48 hours, washed free of sodium chloride with distilled water and dried at room temperature. The separated P-38 pigment was bright pink/purple, had a particle size of 0.1 micrometer and exhibited peaks at diffraction angles (2Θ) of 5.59°, 9.85°, 11.5°, 25.2° and 25.9°. In comparison, the crude pigment exhibited a more crystalline diffraction pattern with diffraction peaks at 5.96°, 10.0°, and 12.9° in the X-ray diffraction pattern obtained with CuKα radiation.

A coating composition for forming a charge-generation layer (CGL) was prepared by adding 3 g of the P-38 pigment particles and 1 g of polyvinylbutyral binder to 96 g of methylisobutyl ketone and ball milling for 72 hours. The composition was diluted to 4.5 percent solids with methylisobutyl ketone. The resulting dispersion was coated on a conductive support comprising a thin conductive layer of nickel on poly(ethylene terephthalate) film to provide a CGL of 0.7 micrometer thickness.

A coating composition for forming a charge-transport layer (CTL) was prepared comprising 11 weight percent solids dissolved in dichloromethane. The solids comprised 4 g of 1,1-bis(4-di-p-tolylaminophenyl)-3-phenylpropane, a charge-transport material, and 6 g of a binder comprising bisphenol A polycarbonate. The coating composition was coated onto the CGL and dried to a thickness of 18 micrometers. The resulting multi-active layer electrophotographic recording element was then charged to a uniform potential of −500 V, exposed at its maximum absorption wavelength of 520 nm and discharged to −100 V. The energy required in ergs/cm$^2$ (photodecay) was 5.8 ergs/cm$^2$. The dark discharge rate for the element (dark decay) observed 10 seconds after charging was 4 V/sec.

For comparison, a multi-active layer electrophotographic recording element was prepared by vacuum deposition using the materials described previously in this Example 1. In preparing the element, a 0.25 micrometer thick layer of P-38 was vacuum deposited on the support by sublimation from a resistance-heated tatalum crucible at a temperature of 350° C., a pressure of $5\times10^{-5}$ Torr, and a crucible to support distance of 15 cm. The nickel coated poly(ethylene terephthalate) support was at a temperature of 50° C. The vacuum deposited layer was overcoated at a temperature of 25° C. with the CTL coating composition described previously in this Example 1 and dried to give a thickness of 18 micrometers. The resulting multi-active layer electrophotographic recording element was then charged and exposed under the same conditions as the dispersion coated element prepared previously in this Example 1. The photodecay was 11 ergs/cm$^2$ and the dark decay was 2 V/sec. Thus the electrophotographic recording element of this invention exhibited a two-fold increase in electrophotographic speed compared to the electrophotographic recording element prepared using vacuum sublimation.

EXAMPLE 2

The procedure of Example 1 was repeated except that the P-38 perylene pigment was replaced with different perylene pigments. The pigments used and the photodecay values obtained with the electrophotographic recording elements prepared and tested according to the procedures of Example 1, are reported in the following Table.

TABLE

| | Element of Invention | | Vacuum Deposited Electrophotographic Recording Element | |
|---|---|---|---|---|
| Perylene Pigment | Photodecay (ergs/cm) | Dark Decay (V/sec) | Photodecay (ergs/cm) | Dark Decay (V/sec) |
| P-1 | 3.1 | | 2.5 | |
| P-3 | 2.6 | | 2.9 | |
| P-39 | 8 | | 10 | |
| P-40 | 15 | | 16 | |
| P-44 | 9 | | 14 | |
| P-45 | 20 | | 30 | |
| P-51 | 15 | | 22 | |
| P-54 | 15 | | 22 | |

The photodecay values reported in the above table clearly demonstrate that the electrophotographic recording elements of this invention meet or exceed the electrophotographic speed for comparable electrophotographic recording elements containing vacuum deposited photoconductive perylene pigments.

The invention has been described in detail with particular reference to preferred embodiments thereof, but it will be understood that variations and modifications can be effected within the spirit and scope of the invention.

What is claimed is:

1. An electrophotographic recording element having a layer comprising a photoconductive perylene pigment that is sufficiently finely and uniformly dispersed in a polymeric binder to provide the element with an electrophotographic speed at least substantially equivalent to the electrophotographic speed of an element having a corresponding layer formed from the same pigment by vacuum sublimation in the absence of said polymeric binder, said perylene pigment having the formula:

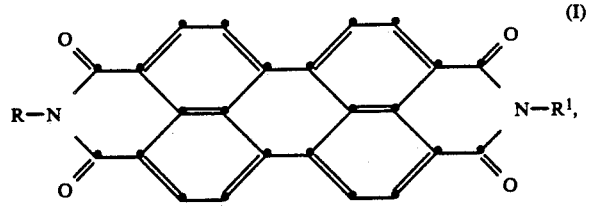

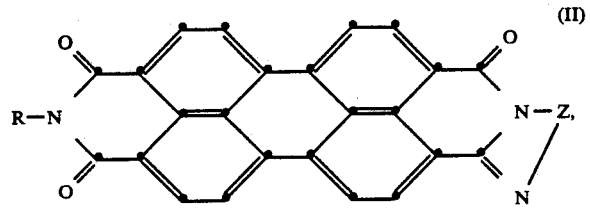

or

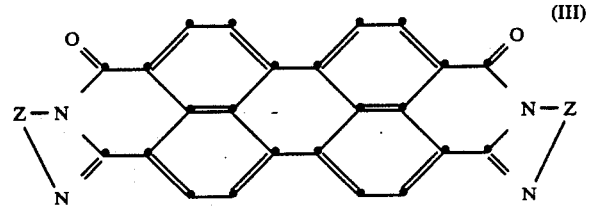

where each R is a phenethyl radical, $R^1$ is hydrogen, alkyl, cycloalkyl, aralkyl, aryl, heteroaryl, alkoxy, mono- or dialkylamino, or when the compound of Formula I is a dimer, $R^1$ is 1,4-phenylene, each Z is 2,3-naphthylene, 2,3-pyridylene, 3,4-pyridylene, 3,4,5,6-tetrahydro-1,2-phenylene, 9,10-phenanthrylene, 1,8-naphthylene, the radical

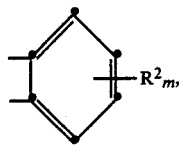

where $R^2$ is alkyl, cycloalkyl, aralkyl, aryl, heteroaryl, alkoxy, dialkylamino, halogen, cyano, or nitro, or when the compound of Formula II is a dimer, Z is 1,2,4,5-benzenetetrayl or 3,3',4,4'-biphenyltetrayl, and m is a number from 0 to 4, 2. The electrophotographic recording element of claim 1, wherein the perylene pigment has the formula I.

3. The electrophotographic recording element of claim 2, wherein $R^1$ is aralkyl.

4. The electrophotographic recording element of claim 2, $R^1$ is phenethyl.

5. The electrophotographic recording element of claim 2, wherein each of R and $R^1$ is phenethyl.

6. The electrophotographic recording element of claim 2, wherein R is phenethyl and $R^1$ is m-methyl-substituted phenethyl.

7. The electrophotographic recording element of claim 1, wherein the perylene pigment has the formula II.

8. The electrophotographic recording element of claim 7, wherein Z is the radical

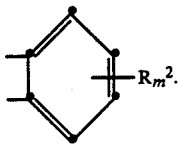

9. The electrophotographic recording element of claim 8, wherein R is phenethyl and m is 0.

10. The electrophotographic recording element of claim 1, wherein the perylene pigment has the formula III.

11. The electrophotographic recording element of claim 1, wherein the perylene pigment has a particle size up to about 0.2 micrometer.

12. The electrophotographic recording element of claim 1, wherein the element is a multi-active element comprising a charge-generation layer containing the photoconductive perylene pigment dispersed in a polymeric binder, and a charge-transport layer.

* * * * *